United States Patent [19]

Bay

[11] 4,348,935

[45] Sep. 14, 1982

[54] THUMB REST FOR WOODWIND MUSICAL INSTRUMENTS

[76] Inventor: Charles L. Bay, 1285 Brookview Ave., Westlake Village, Calif. 91361

[21] Appl. No.: 145,717

[22] Filed: May 1, 1980

[51] Int. Cl.[3] ..... G10D 3/18

[52] U.S. Cl. ..... 84/380 R; 84/382; 84/453

[58] Field of Search ..... 84/380 R, 382, 385 A, 84/453

[56] References Cited

U.S. PATENT DOCUMENTS

| | | | |
|---|---|---|---|
| 2,803,983 | 8/1957 | Dowling | 84/453 |
| 2,847,892 | 8/1958 | Laas et al. | 84/380 R |
| 2,933,968 | 4/1960 | Hearne et al. | 84/380 R |
| 3,988,958 | 11/1976 | Brunkow | 84/453 |

*Primary Examiner*—L. T. Hix
*Assistant Examiner*—Alan Mathews
*Attorney, Agent, or Firm*—Fulwider, Patton, Rieber, Lee & Utecht

[57] ABSTRACT

An improved thumb rest and thumb rest mounting bracket for woodwind musical instruments such as clarinets, oboes, and saxophones, wherein the weight of the instrument is distributed evenly over a large portion of the player's thumb, and the thumb may be positioned so that the fingers are properly placed for opening and closing the tone holes and operating the keys of the instrument. The thumb rest is shaped concavely to conform to the lateral curvature of the player's thumb to provide support and a positive positioning of the thumb when placed in contact with the thumb rest. The thumb rest is attached to the instrument body with a thumb rest attachment bracket that is adjustable, providing adjustment of the position of the thumb rest rotationally about an axis parallel to that of the clarinet, radially outward from this axis of the clarinet, and axially parallel to the axis of the clarinet.

7 Claims, 5 Drawing Figures

THUMB REST FOR WOODWIND MUSICAL INSTRUMENTS

BACKGROUND OF THE INVENTION

This invention relates generally to woodwind musical instruments of the clarinet, oboe, and saxophone families, and, more particularly, to an improved thumb rest for such instruments.

The modern clarinet, saxophone and oboe are woodwind instruments having a cylindrical bore and single reed mouthpiece, a conical bore and single reed mouthpiece, and a conical bore and double reed, respectively. The varying musical sounds of such instruments are produced by selectively covering and uncovering tone holes in the body of the instrument, either directly with the fingers, or indirectly through finger-accuated keys. Both hands of the musician are required to operate the instrument. The hands are placed in contact with the instrument, one above the other, in a relatively fixed location. In this position, the fingers are lifted or depressed to produce notes.

During playing the weight of clarinets, oboes and saxophones is supported in a similar manner. Typically, the right hand of the player is the lower hand on the instrument and supports the instrument. The weight of the instrument is supported to a great extent by the thumb of the lower hand, and a projection termed the thumb rest is provided for this purpose. The thumb of the lower hand is placed below the thumb rest, so that the inner side surface of the thumb contacts the thumb rest, thereby supporting the instrument.

The position and general flexure of the hands and fingers is important to the proper playing of woodwind instruments. The arrangement of the human hand is such that the thumb and fingers generally form a "U" shape when the hand is open, and this changes slightly toward an "O" shape when the instrument is grasped for playing and the fingers are placed in their proper positions. A relaxed positioning of the fingers should ensure a minimal amount of tension as well as correct positioning of the fingers for achieving a dexterous, quick and smooth up-and-down movement. With such positioning, each finger is properly aligned for efficient opening and closing of the tone holes. This positioning also allows each joint of a finger to remain in a relatively fixed position, forming with its adjacent joints a gentle arc. When the finger is moved during playing, the joints on the finger remain in a relatively fixed position and movement is provided from the joint at the point where each finger is attached to the palm of the hand. If the hand is in too closed or too open a position, the fingers cannot properly operate in this manner and the ability of the player is inhibited.

The thumb of the lower hand does not operate any tone holes, but its positioning significantly affects the curvature and tension in the fingers of that hand. The position and orientation of the instrument is determined, to a large extent, by the proper positioning of the thumb in contact with the thumb rest. The positioning of the thumb directly determines the distance between the body of the instrument and the palm of the lower hand, thereby determining the necessary arc for the fingers to contact the tone holes and keys. If the thumb is not properly positioned in relation to the thumb rest, the fingers may be either overextended, requiring a flat arc and making it difficult to reach the tone holes, or the fingers may be bent too sharply, with the result that the fingers are cramped and constricted in their movement.

Additionally, the woodwind instruments are heavy, and the thumb of the lower hand, engaging the thumb rest, must provide much of the support for the instrument. Playing periods of long duration may tire the muscles of the thumb, thereby inducing tension. This tension may be transmitted to the balance of the hand, the fingers, the wrist and forearm. Faced with this tension and tiredness of the muscles, the player of the instrument may compensate by adjusting the position of his hands in relation to the instrument, and may depart from the correct positioning for the best playing of the instrument. Thus, proper positioning of the thumb of the lower hand in relation to the thumb rest is of critical importance in allowing the player to maintain optimal playing position.

The problems noted above are particularly acute for beginning students of the instruments. Beginners sometimes do not naturally adopt the correct hand and finger positioning on the instrument, and this positioning must be taught. If the student's natural tendency is to adopt a position other than the proper one, during long practice and performance periods the natural tendency of the player may be to compensate for the heavy weight of the instrument by changing the hand position so as to either overextend or cramp the fingers. Bad habits may therefore be developed, particularly when the student is not being closely watched by the instructor.

The conventional thumb rest, which has been in general use since the 17th century, is a fixed metal projection covered with cork or felt and having a slight curvature convex to the thumb. Such conventional thumb rests are typically approximately one-half inch by one-half inch in size, and provide no positive indication as to the proper positioning of the thumb. One improvement to this basic thumb rest has increased the effective surface area by introducing padding to improve the player's comfort. Another improvement has introduced a thumb rest shaped to engage the end of the player's thumb and having limited adjustability. Another improvement has provided for limited axial and rotational adjustment of the conventional thumb rest. Prior improvements have not, however, provided for an improved support surface for the player's thumb which simultaneously induced proper positioning of the thumb, hand, and fingers.

Accordingly, there has been a need for an improved thumb rest assembly that simultaneously assists the player in properly positioning his lower hand and also provides for improved support of the weight of the instrument over a larger area of the thumb, thereby improving the comfort of the performer. The present invention fulfills this need.

SUMMARY OF THE INVENTION

The present invention resides in an improvement for a woodwind instrument thumb rest assembly wherein the thumb rest is concavely curved to conform approximately to the shape of the lateral curvature of the player's thumb. A further aspect is that the thumb rest assembly is adjustable through rotation and linear movement in two directions and rotation so that the player's lower hand may be properly and comfortably positioned for opening and closing of the tone holes. Accordingly, when the thumb rest assembly is properly adjusted to the individual hand of the player, there is a correct "feel" for the player and consequently no tendency to adopt an improper positioning of the hand while playing, even during long passages when the player may become fatigued.

More specifically, the improvement of the invention comprises a thumb rest assembly composed of a thumb rest and a thumb rest mounting bracket. The thumb rest is concavely curved to fit the shape of the lateral curvature of the supporting thumb. The thumb rest is attached to the body of the instrument by means of a thumb rest mounting bracket. The thumb rest mounting bracket is provided with means for adjusting the positioning of the thumb rest through rotation of the thumb rest about an axis parallel to that of the instrument, by movement of the thumb rest radially in relation to the body of the instrument and by movement of the thumb rest axially along the body of the instrument. In the presently preferred embodiment of the invention, these adjustment functions are attained by securing the thumb rest to the thumb rest mounting bracket using a single bolt in a radial slot in the thumb rest mounting bracket. Spacers may be inserted between the mounting bracket and the thumb rest or the attachment post may be shortened to provide axial adjustment of the thumb rest position. In this preferred embodiment, the thumb rest is concavely curved to fit the lateral curvature of the thumb, including a tab which conforms to a portion of the lower surface of the thumb to provide additional support and a sense of security in the player's mind that the instrument will not slip. The thumb rest is constructed of sufficiently thin metal that it may be recontoured slightly to provide a better fit with the thumb of the player. The surface of the thumb rest in contact with the thumb is covered by a contact material such as felt or cork, to provide cushioning and a reduced possibility of slippage as the player moves his fingers to various tone holes and keys; alternatively, the thumb rest surface may be covered with a resilient material such as rubber which cushions and conforms to the thumb even as the thumb moves during playing.

It will be appreciated from the foregoing that the present invention represents a significant advance in the woodwind instrument field. With this improved thumb rest assembly, the thumb rest may be adjusted for the individual shape and size of the hand of the player, thereby allowing each instrument to be tailored to the needs of the performer. As a result, the fingers of the performer that operate the tone holes and keys may be properly positioned individually for each user of the instrument. Moreover, with the thumb rest properly adjusted, the performer will experience less fatigue and tension during long performing periods. Other features and advantages of the present invention will become apparent from the following more detailed description, taken in conjunction with the accompanying drawings, which illustrate, by way of example, the principles of the invention.

DESCRIPTION OF THE PREFERRED EMBODIMENT

Figure 1:
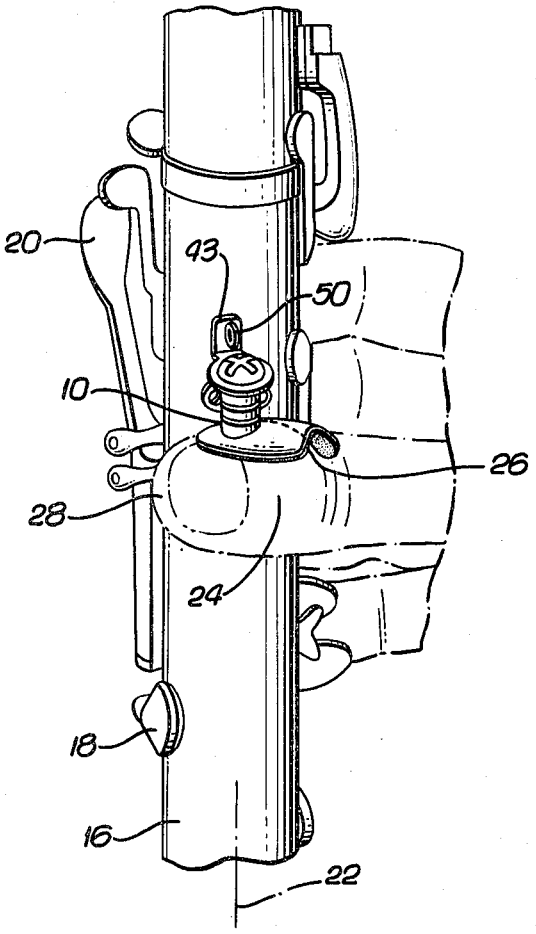
FIG. 1 is a fragmentary perspective view of the lower portion of a clarinet including a thumb rest assembly in accordance with the present invention.

As is shown in the drawings with reference to a clarinet for purposes of illustration, the present invention is concerned with an improved thumb rest assembly 10 for woodwind instruments. This thumb rest assembly includes a thumb rest 12 generally conforming to the lateral curvature of the users' thumb, and a thumb rest mounting bracket 14 for adjustably mounting the thumb rest to the body of the instrument.

In accordance with the present invention, the thumb rest 12 is curved concavely toward the player's thumb to fit the lateral surface of the thumb, and has a rigidly secured internally threaded attachment post 32. The thumb rest mounting bracket 14 is rigidly attached to the body 16 of the clarinet and has a slot 44 extending through the bracket. The thumb rest 12 is attached to the thumb rest mounting bracket 14 by a bolt 46 engaging the attachment post 32 through the slot 44 in the thumb rest mounting bracket.

The thumb rest 12 and the thumb rest mounting bracket cooperate to distribute the weight of the clarinet over a large portion of the thumb. This cooperation also allows the clarinet to be properly positioned in the hands of the player so that the fingers may open and close the tone holes and operate the keys most effectively, and there is reduced tendency for the player to adopt any other position of the hands, even after playing for long periods of time.

A clarinet has a body 16, which is essentially an elongated thick-walled cylinder, although some portions are conical. Clarinets are typically constructed of wood, plastic or metal. The instrument is played by blowing through a single reed mouthpiece, and the various musical notes are produced by a combination of the blowing technique and the covering or uncovering of tone holes located in the body 16. The tone holes are covered either directly by the fingers or by pads, such as the one shown at 18, operated by finger-actuated keys, such as the one shown at 20. As the clarinet has the shape of an elongated cylinder, the instrument may be said to have an "axis" 22 at the center of the bore enclosed by the cylindrical walls. FIG. 1 shows a fragmentary portion of the clarinet body with keys mounted thereon.

To describe the construction of the thumb rest assembly 10, the surfaces of the player's thumb must first be defined. In this usage, the surface of the thumb where the thumb nail is located is termed the "upper side" 24. The opposite surface, where the pattern of ridges making up the thumb print is located, is termed the "lower surface". The lateral surface of the thumb located adjacent to the upper and lower surfaces and lying within the "U" formed between the thumb and the first finger is termed the "inner side" 26. The "end" 28 of the thumb is the surface furthest from the thumb joints and lying generally perpendicular to the upper, lower, and inner side surfaces of the thumb. The curvature of the thumb including the inner side surface and extending toward the lower surface is the "lateral curvature".

Figure 2:
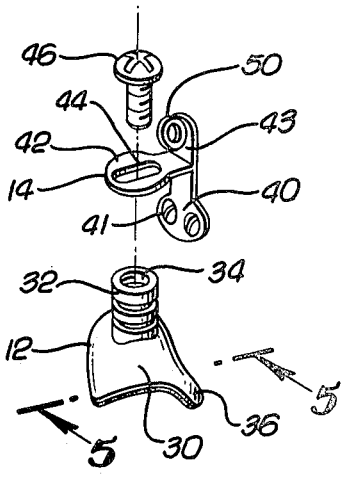
FIG. 2 is a fragmentary exploded perspective view of the thumb rest assembly of FIG. 1.
Figure 3:
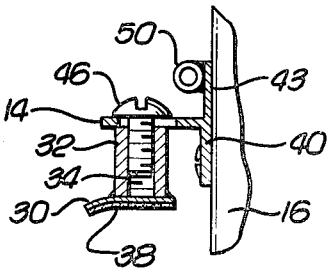
FIG. 3 is an elevational view, partly in section, of the thumb rest mounting bracket and the adjacent portion of the thumb rest.
Figure 5:
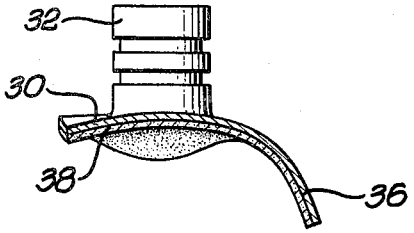
FIG. 5 is a sectional view of the thumb rest taken substantially along the line 5—5 in FIG. 2, and showing the curved tab of the preferred embodiment.

As illustrated in FIG. 2, the thumb rest 12 includes a thumb support plate 30 having a shape concave toward the thumb generally adapted to fit the lateral curvature of the player's thumb and an integral attachment post 32 having a threaded hole 34 and adapted for attaching to the thumb rest mounting bracket 14. The weight of the clarinet is supported through the thumb rest by the player's thumb. In the illustrated preferred embodiment, the thumb support plate 30 includes a lip 36 projecting in and downward to conform to the lower surface of the player's thumb as illustrated in FIG. 5. This configuration provides additional support and balance for the player. The portion of the thumb support plate 30 actually in contact with the player's thumb is covered with contact material 38, such as cork, felt or resilient rubber, to provide a reduced possibility of slippage and to cushion the contact between the thumb and the thumb support plate 30. The use of a resilient material such as rubber as the contact material 38 provides the special advantage of changing shape to conform to the thumb even as the thumb moves slightly during playing. The thumb support plate 30 may be constructed of a relatively pliable material that can be reshaped to provide better contact with the player's thumb. For example, the thumb support plate 30 may be constructed from a thin piece of metal which may be intentionally recontoured to conform better to the player's thumb. The shape of the thumb support plate 30, the lip 36 and the contact material 38 cooperate to distribute the weight of the instrument over a large portion of the player's thumb and to position the player's thumb properly with respect to the clarinet. Thus, the shape of the thumb support plate 30 may be varied either by the reshaping of the metal or by the use of a resilient contact material.

Figure 4:
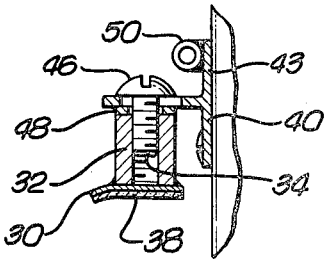
FIG. 4 is an elevational view similar to FIG. 3, except that a spacer is inserted for axial adjustment.

The thumb rest mounting bracket 14 mounts the thumb rest rigidly but adjustably to the body 16 of the clarinet. The thumb rest mounting bracket 14 is generally "L-shaped", having an attachment portion 40 adapted for attachment to the body of the clarinet with screws or other suitable means, and a tab 42 having a slot 44 and projecting perpendicular to the body 16 of the clarinet. The attachment portion 40 typically has attachment holes 41 for attaching the thumb rest assembly 10 to the body 16 of the clarinet. These attachment holes 41 may be either circular or slotted to allow use of a single type of thumb rest mounting bracket 14 with different instruments having varying spacing of the attachment points. A thumb rest attachment extension 43 may be added to the thumb rest mounting bracket 14 for aesthetic reasons and to serve as the attachment location for a support ring 50. It is sometimes desirable to support a portion of the weight of the instrument using a strap around the player's neck, and this strap is connected to the instrument at the support ring 50. The thumb rest attachment post 32 is connected to the tab 42 with a bolt 46 extending through the slot 44 and engaging the threaded hole 34 in the attachment post 32. As shown in FIG. 4, a spacer 48 may be inserted between the tab 42 and the attachment post 32 to provide adjustment of the positioning of the thumb rest parallel to the axis 22 of the clarinet. The thumb rest 12 may be adjusted rotationally by loosening the bolt 46, rotating the thumb rest and retightening the bolt with the thumb rest held in the new position. The position of the thumb rest 12 may be adjusted radially outward from the axis 22 of the clarinet by loosening the bolt 46, sliding the thumb rest along the slot 44 and then retightening the bolt. The combination of rotational adjustment, axial adjustment and radial adjustment, together with the reshaping of the thumb support plate 30, allows the repositioning of the thumb support plate 30 and thence the thumb, hand and fingers of the player to provide optimal positioning for playing the instrument.

In practice, an experienced clarinet player or the teacher of an inexperienced player may observe the positioning of the hand and fingers of the player as related to the thumb rest assembly 10, after both short and long periods of playing. The thumb rest assembly 10 may then be adjusted to achieve the optimal positioning, and the process repeated. Incremental adjustments thereby lead to a permanent proper positioning of the hand of the player on the instrument.

It will now be appreciated that, through the use of this invention, a woodwind musical instrument may be adjusted to the size and shape of the hands of the user. This tailoring process insures that the player utilizes the correct finger positioning for playing the instrument. Although a particular embodiment of the invention has been described in detail for purposes of illustration, various modifications may be made without departing from the spirit and scope of the invention. Accordingly, the invention is not to be limited except as by the appended claims.

I claim:

1. In a woodwind musical instrument wherein at least a portion of the weight of the instrument is supported by a thumb of the player through a thumb rest, the improvement comprising a concave thumb support plate portion of the thumb rest shaped to conform to the lateral curvature of the player's thumb, said support plate having its concave shape prior to contacting the player's thumb.

2. In a woodwind musical instrument whose weight is supported at least in part by a thumb rest, the improvement comprising:

means for adjusting the position of said thumb rest parallel to the axis of the instrument;

means for adjusting the position of said thumb rest radially with respect to the axis of the instrument; and means for rotating said thumb rest about an axis parallel to the axis of the instrument.

3. In a woodwind musical instrument having a thumb rest, an improved thumb rest assembly, comprising:

a concavely curved thumb support plate, said support plate having a shape conforming to the lateral curvature of a player's thumb prior to contacting to the player's thumb; and means for adjustably mounting said thumb support plate rigidly on said instrument.

4. In a woodwind musical instrument having a thumb rest, an improved thumb rest assebly, comprising:

a concavely curved thumb support plate shaped to conform to the lateral curvature of a player's thumb; and means for adjustably mounting said thumb support plate on said instrument, wherein said means for adjustably mounting include means for adjusting said thumb support plate rotationally about an axis parallel to the axis of the musical instrument, adjusting said thumb support plate radially with respect to the axis of the musical instrument, and adjusting said thumb support plate parallel to the axis of the musical instrument.

5. The thumb rest assembly of claim 3, wherein the shape of said thumb support plate may be varied to conform to the shape of the user's thumb by reshaping the material comprising said plate.

6. In a musical instrument of the clarinet family, an improved thumb rest assembly, comprising:

a thumb rest having a concavely curved thumb support plate made of material sufficiently pliable to be shaped to conform a surface of said thumb support plate to the lateral curvature of a player's thumb;

an attachment post rigidly secured to said thumb support plate;

a thumb rest mounting bracket having a radial slot through said bracket; and a bolt engaging said attachment post through said slot;

whereby said thumb rest is rigidly but adjustably attached to the body of the clarinet.

7. The improvement of claim 1, wherein the shape of said support plate may be varied to conform to the shape of the player's thumb by reshaping the material comprising said plate.

* * * * *